United States Patent [19]

Kieffer

[11] 4,095,978

[45] Jun. 20, 1978

[54] HARD TANTALUM NITRIDE BASE ALLOYS

[75] Inventor: Richard Kieffer, Vienna, Austria

[73] Assignee: Ugine Carbone, Grenoble, France

[21] Appl. No.: 739,065

[22] Filed: Nov. 5, 1976

Related U.S. Application Data

[63] Continuation of Ser. No. 519,923, Nov. 1, 1974, abandoned.

[51] Int. Cl.[2] ..... C22C 1/05; C22C 29/00

[52] U.S. Cl. ..... 75/238; 75/204; 75/205; 75/224; 75/227; 75/244

[58] Field of Search ..... 75/201, 205, 224, 226, 75/227, 238, 204, 244

[56] References Cited

U.S. PATENT DOCUMENTS

| | | | |
|---|---|---|---|
| 2,040,592 | 5/1936 | Becker | 75/238 |
| 3,379,520 | 4/1968 | Chang | 75/174 |
| 3,409,416 | 11/1968 | Yates | 428/539.5 |
| 3,409,419 | 11/1968 | Yates | 428/539.5 |
| 3,713,906 | 1/1973 | Thyne | 148/31.5 |
| 3,741,733 | 6/1973 | Kieffer | 75/238 |

*Primary Examiner*—Richard E. Schafer

*Attorney, Agent, or Firm*—McDougall, Hersh & Scott

[57] ABSTRACT

The invention relates to hard fritted alloys and a method for their preparation. These alloys essentially contain cubic tantalum nitride with a binder based on carbides or nitrides of metal of groups IV-A and V-A, likewise of cubic structure, fritted at a temperature from 1400° to 1700° C at a nitrogen pressure from 30 to 200 bars. They are particularly appropriate for the manufacture of tools for cutting metal.

5 Claims, No Drawings

HARD TANTALUM NITRIDE BASE ALLOYS

This is a continuation of application Ser. No. 519,923, filed Nov. 1, 1974, now abandoned.

The invention relates to new compounds of hard alloys.

It is known that hard fritted alloys are constructed for example from mixtures of powders of carbides, nitrides of a metallic nature and of bonding metals or alloys, in variable proportions which are fritted at a high temperature. The mechanical qualities of these products make them appropriate, particularly for the manufacture of tools for cutting metal.

The hard alloys according to the invention are composed of a hard phase (70 to 97% of the weight of the alloy) which contains at least 73% of tantalum nitride $TaN_x$ ($0.66 \geqq x \geqq 1$) of a cubic structure and possibly at least some other metallic compound, carbide or nitride of a cubic structure, of metals of groups IV-A and V-A and a binder (3 to 30% of the weight of the alloy) which contains at least 70% of at least one of the metals iron, cobalt, nickel and possibly at least one of the metals chrome, molybdenum, tungsten.

The proportion of hard phase preferably represents 85 to 94% of the weight of the alloy.

The presence of metal of the chrome group in the binder improves the mechanical strength and the resistance against corrosion of the hard fritted alloy.

The most stable form of tantalum nitride is $Ta_2N$ in hexagonal form whose hardness is on the order of 1700 HV. However, the cubic TaN form has a hardness on the order of 3,000 HV which makes it possible to obtain fritted pieces whose hardness exceeds 1600 HV, which is particularly interesting for cutting tools.

The cubic mono tantalum nitride $TaN_x$ ($0.66 \geqq x \geqq 1$), which hereinafter shall be called cubic nitride, is stable only above 1500° C and under strong nitrogen pressure, while the stable form under ordinary conditions has the hexagonal form. In order to produce it, hexagonal TaN is treated in an autoclave at 1700° C at least for 1 hour under a nitrogen pressure of at least 5 bars and then it is cooled rapidly to maintain cold, thanks to a tempering pheomenon, the form obtained when hot.

The hard fritted alloys of the invention can be prepared from a mixture of powders of the components which will be shaped and heated to between 1400° and 1700° C at a nitrogen pressure from 30 to 200 bars during more than 1 hour and then they are rapidly cooled.

However, it is advantageous to frit a mixture of powders of binder and of solid solutions containing cubic tantalum nitride. For that, the powders of mixed crystals are previously prepared in the following manner. Hexagonal tantalum nitride in powder and at least one carbide or cubic nitride in powder form of metals of the groups IV-A and V-A are mixed and heated to between 1500° and 1800° C under a nitrogen pressure of 20 to 200 bars for at least 2 hours, then this is rapidly cooled to temper the mixed crystals obtained. Applicant has discovered indeed that the cubic tantalum nitride, when it is in solid solution with other cubic compounds has less of a tendency of being transformed either into hexagonal nitride when heated to bring it to the fritting temperature or into semi-nitride $TaN_2$ if the nitrogen pressure is insufficient during the fritting.

The following examples illustrate various hard alloy compounds according to the invention and their manufacture:

EXAMPLE 1

91 parts hexagonal tantalum nitride are mixed with 1 part titanium carbide in the form of a fine ground powder, which is compressed (0.5 to 2 t/cm$^2$) and heated to 1600° C under a pressure of 30 bars in an autoclave with graphite resistance. After rapid cooling and after increasing the pressure to 100 bars, a product of a yellow color and cubic structure is obtained. The crushed product is mixed with 7 parts nickel and 1 part iron in powdered form, under liquid grinding in a ball mill; it is then dried and compressed, then fritted again in an autoclave of appropriate construction, at 1500° C at a pressure of 150 bars nitrogen for more than 2 hours. The hard alloy platelets obtained had a cubic structure, a hardness of 1850 Vickers and a resistance against bending of 100 to 120 kg/mm$^2$.

EXAMPLE 2

75 parts hexagonal tantalum nitride, obtained by treating tantalum powder with gaseous ammonia at 1350° C, were mixed with 10 parts tantalum carbide, ground and heated to 1500° C for 4 hours at a nitrogen pressure of 50 bars. A solid homogeneous solution resulted therefrom in cubic phase.

85 crushed parts of the above solution were mixed with 12 parts nickel and 3 parts molybdenum, both in powder form, ground in a crusher and treated like in Example 1. The fritting was done at 1450° at a nitrogen pressure of 80 bars for 3 hours.

The hard alloy obtained had a hardness of 1700 to 1750 HV and a resistance against bending of 130 to 150 kg/mm$^2$.

EXAMPLE 3

83 parts of tantalum nitride, 10 parts titanium nitride and 2 parts titanium carbide were converted into a homogeneous solid solution according to Example 2; 5 parts of the 80/20 nickel-cobalt mixture were used as binder in powder form. A fritting was carried out at 1600° for 4 hours at a nitrogen pressure of 100 bars.

The hardness obtained was 1780 tl 1850 HV, the resistance against bending was 110 kg/mm$^2$.

EXAMPLE 4

A mixture of 70 parts cubic tantalum nitride, prepared according to Example 1, 10 parts hafnium nitride and 10 parts niobium carbide as well as 10 parts of cobalt-tungsten (80/10) binding powder was ground and pellets were prepared according to a known technique. After fritting at 1650° C for 6 hours and at a pressure of 150 bars of nitrogen, a hard alloy resulted containing a homogeneous hard phase. In certain frittings, traces of a separate cubic phase appeared, consisting of hafnium carbide and niobium carbide.

The hardness was 1600 to 1650 HV, the resistance to bending was 100 to 120 kg/mm$^2$.

EXAMPLE 5

70 parts hexagonal tantalum nitride, 10 parts titanium carbide, 10 parts titanium nitride were treated at 1700° C at a pressure of 200 bars nitrogen for 3 hours. The result was mixed homogeneous crystals of cubic phase. 10 parts of nickel-polybdenum (80/20) binding powder were added, the grinding was done under hexane, and the powder was dried, compressed and fritted at 1600° C under pressure of 60 bars nitrogen for 2 hours. Then, during 2 additional hours, the pressure was increased to 150 bars nitrogen.

The hardness obtained was from 1700 to 1750° HV, the resistance to bending was from 120 to 130 kg/mm$^2$.

I claim:

1. A hard, fritted alloy consisting essentially of from 70 to 97 percent by weight of a hard phase and from 3 to 30 percent by weight of a binder, said hard phase comprising cubic tantalum nitride in an amount of at least 73 percent by weight, and the remainder a compound of cubic structure selected from the group consisting of the metallic carbides and nitrides of metals in Groups IV-A and V-A, and said binder comprising at least 70 percent by weight of at least one of the metals selected from the group consisting of iron, nickel and cobalt, and from 0 to 30 percent of at least one of the metals selected from the group consisting of chromium, molybdenum and tungsten.

2. A hard alloy according to claim 1, constituted from 85 to 94% of hard phase and from 6 to 15% of binder.

3. A hard alloy as claimed in claim 1 where the hard phase contains crystals of at least one solid solution of cubic tantalum nitride and at least one other one of the components of cubic structure.

4. A method for manufacturing hard, fritted alloys comprising the steps of:

a. producing a solid solution comprising at least 73 percent by weight cubic tantalum nitride and the remainder a compound of cubic structure selected from the group consisting of the metallic carbides and nitrides of metals in Groups IV-A and V-A, b. mixing the solid solution with a binding powder comprising at least 70 percent by weight of at least one of the metals selected from the group consisting of iron, nickel and cobalt, and from 0 to 30 percent of at least one of the metals selected from the group consisting of chromium, molybdenum and tungsten, c. heating the mixture to a temperature from 1400° to 1700° C. at a nitrogen pressure of 30 to 200 bars, and d. rapidly cooling said alloy.

5. A method in accordance with claim 4 wherein said solid solution is produced by mixing hexagonal tantalum nitride together with said remaining compound, heating this mixture to a temperature from 1500° to 1800° C. under nitrogen pressure from 20 to 200 bars, and rapidly cooling the mixture whereby said solid solution of cubic tantalum nitride and remaining compound is achieved.

* * * * *